US009929486B2

(12) United States Patent
Englaro et al.

(10) Patent No.: US 9,929,486 B2
(45) Date of Patent: Mar. 27, 2018

(54) CABLING SYSTEM AND METHOD FOR CONNECTING ELECTRONIC PRINTED CIRCUIT BOARDS

(71) Applicant: AUTOMOTIVE LIGHTING ITALIA S.p.A., Turin (IT)

(72) Inventors: Andrea Englaro, Turin (IT); Eugenio Medda, Turin (IT); Giuseppe Avolio, Turin (IT)

(73) Assignee: AUTOMOTIVE LIGHTING ITALIA S.p.A., Turin (IT)

( * ) Notice: Subject to any disclaimer, the term of this patent is extended or adjusted under 35 U.S.C. 154(b) by 0 days.

(21) Appl. No.: 15/214,083

(22) Filed: Jul. 19, 2016

(65) Prior Publication Data

US 2017/0025773 A1 Jan. 26, 2017

(30) Foreign Application Priority Data

Jul. 20, 2015 (IT) ..... 102015000035996

(51) Int. Cl.

| | |
|---|---|
| ***H01R 11/00*** | (2006.01) |
| ***H01R 12/73*** | (2011.01) |
| ***H01R 9/03*** | (2006.01) |
| ***H01R 12/72*** | (2011.01) |
| ***H01R 12/75*** | (2011.01) |

(52) U.S. Cl.

CPC ..... *H01R 12/73* (2013.01); *H01R 9/031* (2013.01); *H01R 12/721* (2013.01); *H01R 12/75* (2013.01); *H01R 2201/26* (2013.01)

(58) Field of Classification Search

CPC ..... H01R 12/73; H01R 12/75; H01R 12/721; H01R 4/2416; H01R 11/00; H01R 25/003

USPC ..... 439/404, 502, 503

See application file for complete search history.

(56) References Cited

U.S. PATENT DOCUMENTS 5,242,314 A 9/1993 Di Giulio et al.
5,546,950 A * 8/1996 Schoeckert ..... A61B 5/04286 439/502

(Continued)

FOREIGN PATENT DOCUMENTS

JP 04319267 A 11/1992
JP 2001334888 A 12/2001

OTHER PUBLICATIONS

Italian Search Report dated Apr. 4, 2016 for Italian Application No. UB20152316.

*Primary Examiner* — Hae Moon Hyeon
(74) *Attorney, Agent, or Firm* — Howard & Howard Attorneys PLLC

(57) ABSTRACT

A cabling system and method for connecting, to a plurality of electronic printed circuit boards, a common electrical cable, a grounding cable, and respective electrical board wires, or power supply cables. The system comprises a bundle of electrical cables, and a plurality of multipolar, insulation-piercing connectors placed in succession along said bundle of cables. Each of the connectors is suitable to receive the common electrical cable, the board cable to be connected to the respective electronic board, and the board cables that must be connected to the successive connectors, and is suitable to transmit to a successive insulation-piercing connector, the common electrical cable and the board cables that must be connected to the successive connectors.

11 Claims, 4 Drawing Sheets

(56) References Cited

U.S. PATENT DOCUMENTS

| | | | | |
|---|---|---|---|---|
| 6,174,196 | B1 * | 1/2001 | Pongracz | H05K 7/1459<br>439/130 |
| 6,328,592 | B1 * | 12/2001 | Burke | H01R 4/2429<br>439/404 |
| 6,522,804 | B1 * | 2/2003 | Mahony | G02B 6/4451<br>385/24 |
| 7,070,443 | B2 * | 7/2006 | Tashiro | F21S 48/212<br>439/404 |
| 7,264,498 | B2 * | 9/2007 | Sakiyama | H01R 12/616<br>439/404 |
| 2001/0051453 | A1 * | 12/2001 | Tachi | H01R 4/2433<br>439/404 |
| 2003/0077933 | A1 | 4/2003 | Tashiro et al. | |
| 2006/0197474 | A1 * | 9/2006 | Olsen | H05B 33/0821<br>315/312 |

* cited by examiner

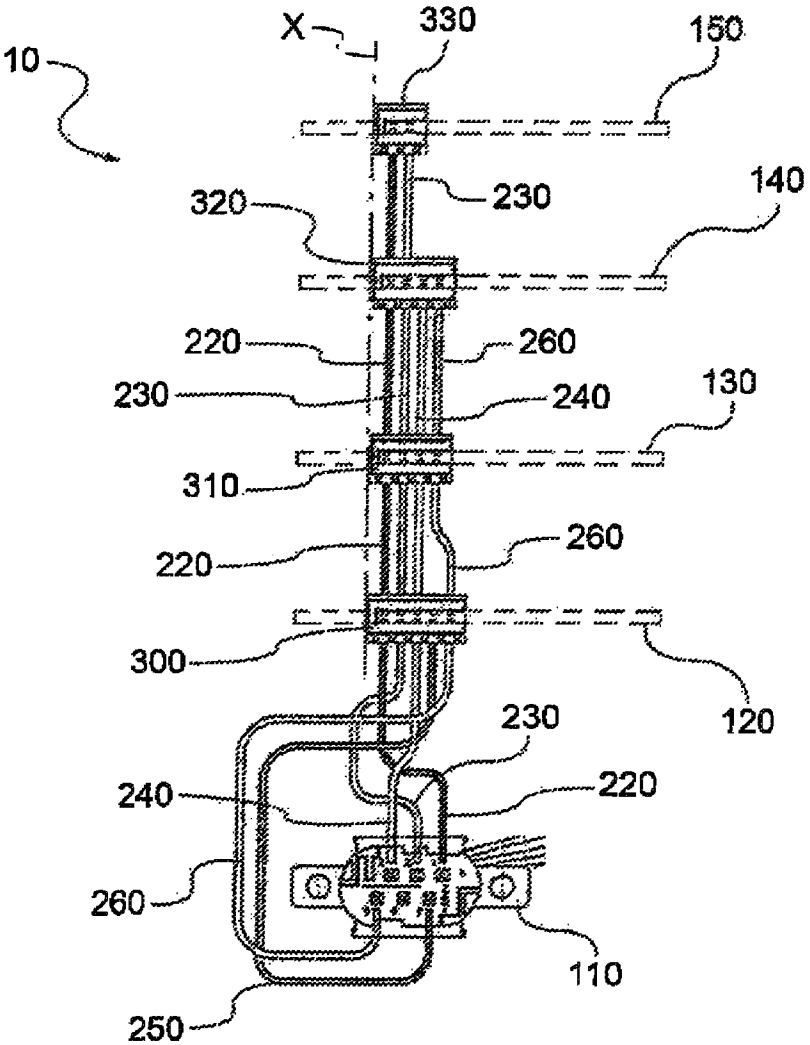
FIG.5
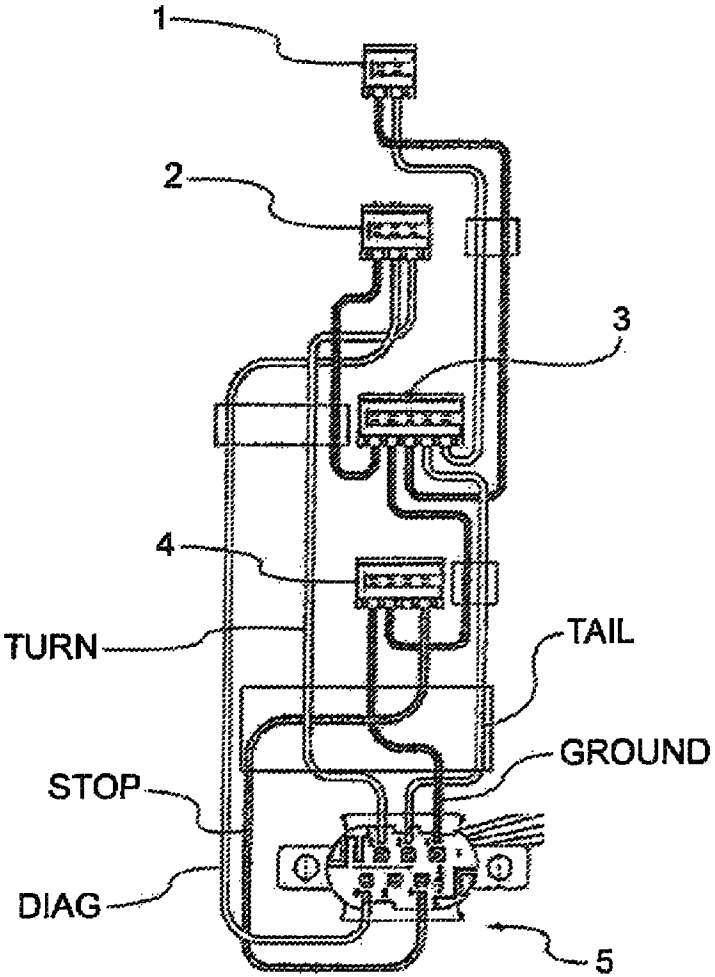
FIG.1 - Prior art

CABLING SYSTEM AND METHOD FOR CONNECTING ELECTRONIC PRINTED CIRCUIT BOARDS

CROSS-REFERENCE TO RELATED APPLICATIONS

The present application claims priority to and all the benefits of Italian Patent Application No. 102015000035996, filed on Jul. 20, 2015, the entire content of which is expressly incorporated herein by reference.

BACKGROUND OF THE INVENTION

1. Field of the Invention

This invention covers a cabling system, in particular to deliver independent electrical power supplies to a plurality of electronic printed circuit boards, for example the boards of a motor vehicle lamp.

2. Description of the Related Art

Many electrical or electronic devices include a plurality of printed circuit boards spaced, and sometimes arranged parallel with each other, to each of which must be brought a respective power supply, the ground and possibly other signals, for example, for diagnostics.

For example, in the same motor vehicle lamp there are printed circuit boards for lights having different functions, for example, position, turn and stop lights, etc. To the light is fixed an electrical connector (called in the jargon "car connector") to which is connected a bundle of power supply, ground and diagnostic cables. The different electronic boards of the light must be connected through respective cables to this connector, so as to be independently powered, connected to ground and possibly controlled by means of diagnostic signals.

In some cases, such as for the motor vehicle lamp, it is of primary importance to perform the electrical cabling of the boards so as to reduce as much as possible the space occupied by the cables, the length of the cables themselves, and optimise the path of the cables to reduce the risk of breakage, overheating, etc.

Moreover, there is a need to perform the cabling of the electronic boards in an automatic or semi-automatic manner.

To attempt to meet these needs, use is often made of insulation-piercing multipolar connectors with a "splitter" function, i.e., in which the electrical cable enters the connector, such as a grounding cable or a power cable, and several output electrical cables exit from the connector, all connected to the input cable and directed towards the boards to be simultaneously connected to earth or powered.

FIG. 1 illustrates a system for cabling the electronic printed circuit boards of a motor vehicle lamp according to the prior art. In the example shown, the motor vehicle lamp comprises two electronic boards for a rear light (Tail Up and Tail Lower), an electronic board for the turn signal (Turn) and an electronic board for the brake light (Stop). To each of these boards is fixed a respective insulation-piercing connector 1 to 4. To the light is fixed an input electrical connector 5 from which extend a GROUND cable, a power supply cable of the rear light TAIL, a power cable of the direction indicator TURN, a power cable of the brake light STOP, and a diagnostic cable DIAG to check the correct operation of the turn signal.

As you can see, the GROUND cable enters the connector 4 of the brake light, exits from this connector 4 and enters the connector 3 of the Tail Low light. From this connector 3, two GROUND cables exit, one directed to the connector 2 of the turn signal and one directed to the connector 1 of the rear light Tail Up.

The power supply cable of the rear light TAIL enters the connector 3 of the Tail Low light, exits from this connector 3 and enters the connector 1 of the Tail Up light.

The power supply cable of the TURN signal enters directly into the connector 2 of the Turn signal.

The power supply cable of the STOP light enters directly into the connector 4 of the Stop light.

The diagnostic cable DIAG enters directly into the connector 2 of the Turn signal.

As can be seen from FIG. 1, although, compared to a traditional connection in which each board is connected to the input electrical connector to the lamp (car connector) in a manner completely independent from the others, the use of splitter connectors allowed achieving a certain rationalisation, at least as regards the ground cable, the cabling system still presents cables that extend between the input electrical connector and boards in a disorderly manner and form branches and curves that can give rise to malfunctions or damage.

SUMMARY OF THE INVENTION

The purpose of this invention is to propose a cabling system capable of eliminating the drawbacks complained about above with reference to the prior art.

This purpose is achieved with a cabling system for connecting, to a plurality of electronic printed circuit boards, a common electrical cable, for example a grounding cable, and respective electrical board wires, for example power supply cables for independently powering at least some of said electronic boards, comprising a bundle of electrical cables comprising the common electrical cable and a plurality of board cables, at least some of the board cables being intended to be connected independently to respective electronic boards. A plurality of multipolar, insulation-piercing connectors are placed in succession along said bundle of cables. Each of said connectors is suitable to be connected to a respective electronic board for electrically connecting, to the electronic board, the common cable and at least board cable, each insulation-piercing connector, with the exception of a connector terminal that terminates the bundle of cables, being suitable to receive the common electrical cable, the board cable to be connected to the respective electronic board, and the board cables that must be connected to the successive connectors, and being suitable to transmit to a successive insulation-piercing connector, or the terminal connector, the common electrical cable and the board cables that must be connected to the successive connectors.

This purpose is also achieved with a cabling method for connecting, to a plurality of electronic printed circuit boards, a common electrical cable, for example a grounding cable, and respective electrical board wires, for example power supply cables for independently powering at least some of said electronic boards, comprising the steps of preparing a bundle of electrical cables comprising the common electrical cable and a plurality of board cables; preparing a plurality of multipolar insulation-piercing connectors, each being suitable to be connected to a respective electronic board for electrically connecting to said electronic board the common cable and at least one board cable, each connector being provided with a plurality of cable seats, at least some of said cable seats being engageable by an insulation-piercing electrical contact; inserting, in a respective cable seat of each insulation-piercing connector, the common electrical cable, the board cable to be connected to the respective electronic board, and the board cables that must be connected to the successive connectors; extracting from the respective cable seats of each insulation-piercing cable connector, with the exception of a terminal connector that terminates the bundle, the common electrical cable and the cables that must be connected to the successive connectors; making the electrical contact between the electric cables and the respective boards.

At last, this purpose is achieved with a motor vehicle lamp comprising a plurality of electronic printed circuit boards suitable to drive respective light sources to realise lights of the lamp, an input electrical connector at the input of the lamp, from which extends a bundle of cables comprising a grounding cable to be connected to all the electronic boards and a plurality of power supply cables, at least some of which to be independently connected to respective electronic boards, and a cabling system of the bundle of cables to the electronic boards as defined herein before.

BRIEF DESCRIPTION OF THE DRAWINGS

Further details and advantages of the cabling system and method according to this invention will, in any case, be evident from the following description of a preferred embodiment, provided by way of non-limiting example, with reference to the accompanying drawings, wherein:

FIG. 1 shows an example of a cabling system for connecting four electronic printed circuit boards to an input connector of a motor vehicle lamp, according to the prior art;

FIG. 5 shows the cabling system of the example of FIG. 1, but realised according to the invention.

DETAILED DESCRIPTION OF THE INVENTION

Figure 2:
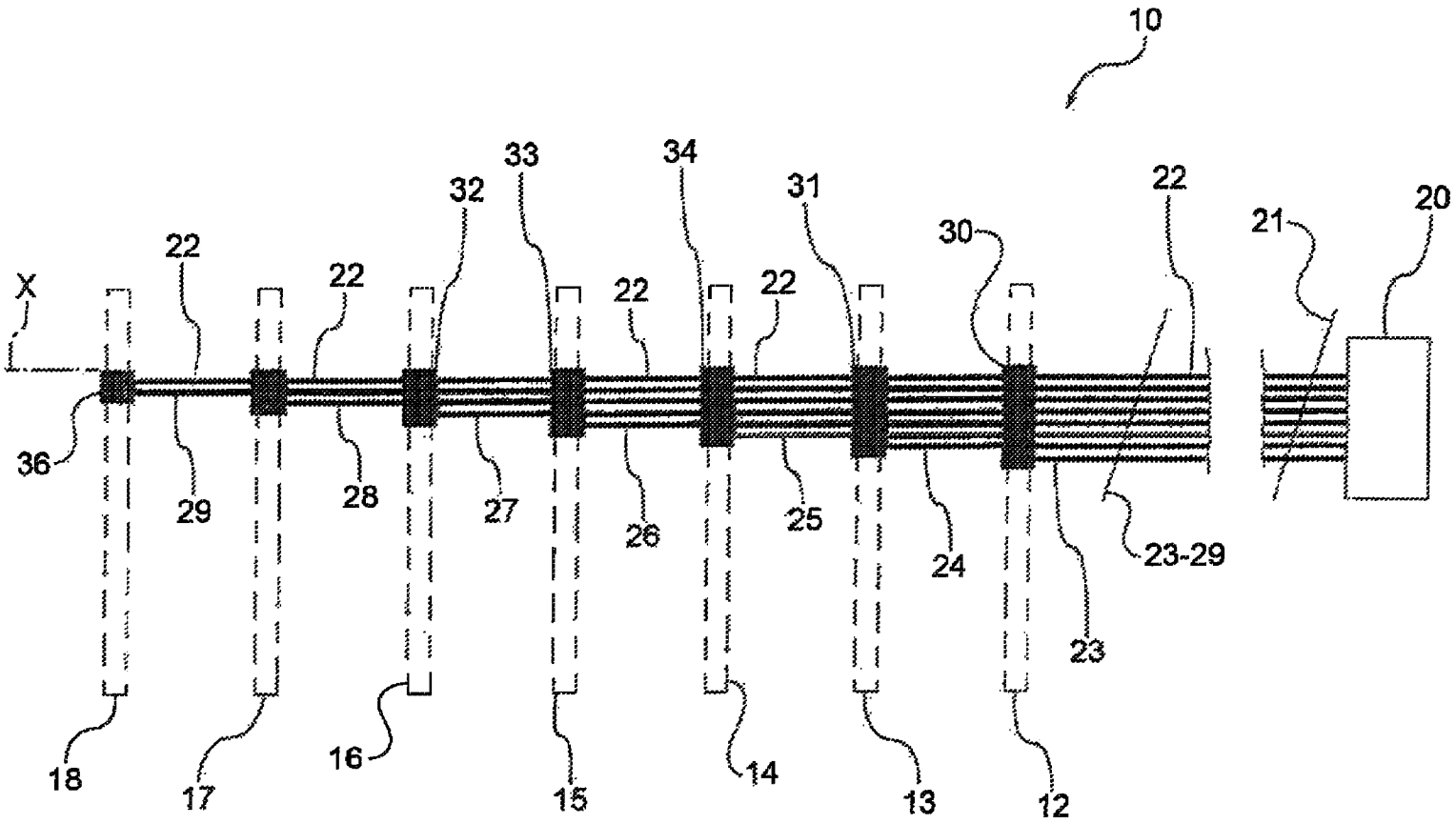
FIG. 2 is a schematic view of a cabling system according to the invention.

With reference to FIG. 2, the reference number 10 indicates, in its entirety, a cabling system for connecting, to a plurality of electronic printed circuit boards 12-18, a common electrical cable 22, for example a grounding cable, and electrical board cables 23-29, for example power supply cables, at least some of such board cables having to be connected to a single, respective, electronic board. In other words, at least some of the boards receive their own board signal independently from each other.

The cabling system 10 comprises a bundle of cables 21, for example coming from an input electrical connector 20. The bundle of cables 21 comprises the common electrical cable 22 and a plurality of board cables 23-29.

The cabling system 10 also comprises a plurality of insulation-piercing multipolar connectors 30-36 placed in succession along the bundle of cables. Each of said multipolar connectors 30-36 is suitable to be connected to a respective electronic board 12-18 for connecting to said electronic board the common electrical cable 22 and a respective board cable.

Insulation-piercing multipolar connector means a multiway connector, i.e., provided with multiple cable seats 40 electrically insulated from each other and suitable to receive respective electrical cables. Furthermore, at least some of these cable seats are engageable by an insulation-piercing electrical contact 42 suitable to pierce, i.e., cut, the insulating sheath that surrounds the conductive wires of the electrical cable, so as to allow a passage of electric current between the conductive wires and the electrical contact. The latter is also electrically connected to a respective terminal of the electronic board to which the connector is fixed.

At least some of the cable seats 40 are pass-through. Pass-through cable seat means that the electrical cord that enters the cable seat passes through the connector and exits from the cable seat to be inserted in the cable seat of a successive connector.

Preferably, the entrance and exit of a pass-through cable seat 40 are aligned with each other.

Figure 4B:
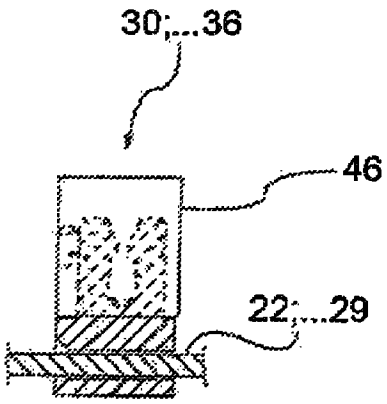
FIG. 4*b* shows, in axial section and in correspondence to a pass-through seat of a cable, an insulation-piercing multipolar connector without the insulation-piercing electrical contact.
Figure 4A:
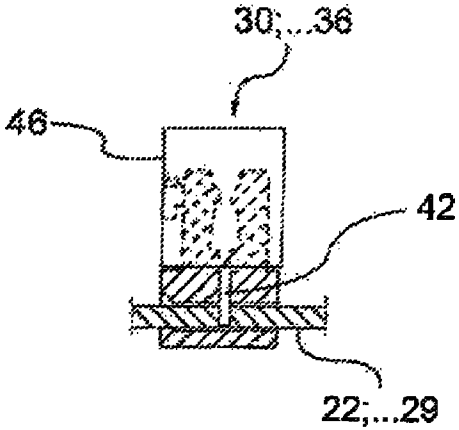
FIG. 4*a* shows, in axial section and in correspondence to a pass-through seat of a cable, an insulation-piercing multipolar connector in the position of piercing the insulating sheath of an electrical cable.

A pass-through cable seat 40 may be provided with an insulation-piercing electrical contact 42 (FIGS. 4, 4*a*) or may be without such an electrical contact (FIG. 4*b*). In this second case, the connector functions merely as a retention and guide element for the electrical cable that is not engaged by the electrical contact.

In one embodiment, all the cable seats have insulation-piercing electrical contacts but not all the electrical contacts are electrically connected to the respective board.

In one embodiment, for reasons of production efficiency, all the cable seats 40 are equal and all are pass-through. The electrical cables that enter in a connector but do not continue towards the successive connectors are simply cut at the exit of the cable seat.

In one embodiment, the insulation-piercing electrical contacts 42 are movable between a retracted position of disengagement from the cable seat, so as to allow the insertion of the cable in the cable seat, and an advanced position, in which they perform the piercing or cutting of the sheath of the cable.

For example, the insulation-piercing connectors comprise two connector parts 44, 46, one movable (44) with respect to the other (46). One part supports the insulation-piercing contacts 42 and the other part forms the cable seats 40.

Each insulation-piercing connector, with the exception of a terminal connector, is thus suitable to receive from a preceding insulation-piercing connector, or from the input connector if it is the first of the plurality of multipolar connectors, the common cable 22, the board cable 23, . . . , 29 for the respective electronic board, and the board cables 23, . . . , 29 intended to be connected to the successive connectors.

Each multipolar connector, with the exception of the terminal connector 36, is also suitable to transmit to a successive multipolar connector or to the terminal connector 36 or the common cable 22 and the board cables that must be connected to the successive connectors.

Therefore, the cabling system 10 comprises at least one terminal connector 36, placed at the distal end of the bundle of cable 21, and a header connector 30, which receives all the cables of the bundle of cables 21.

The header connector 30 is provided with a number of electrically-insulated cable seats in which are inserted the common cable 22 and all the board cables 23-29, for example coming from the input connector 20.

The cable seat of the common cable 22 is pass-through and is engaged by an insulation-piercing contact suitable to electrically connect the common cable 22 to the electronic board 12 connected to the header connector 30. Another cable seat of the header connector 30 receives a board cable 23 and is engaged by an insulation-piercing contact suitable to electrically connect this board cable 23 to the electronic board 12 connected to the header connector 30.

The remaining cable seats 24-29 for board cables are pass-through and the respective electrical cables are not engaged by insulation-piercing electrical contacts.

Between the terminal connector 36 and the header connector 30 is positioned at least one insulation-piercing intermediate connector 31, . . . , 35. This intermediate connector is provided with a number of electrically-insulated cable seats in which are inserted the common cable 22 and the board cables coming from the header connector 30 or from a preceding intermediate connector. The cable seat for the common cable 22 is pass-through and is engaged by an insulation-piercing contact suitable to electrically connect the common cable 22 to the respective electronic board; another cable receives a board cable 24 and is engaged by an insulation-piercing contact suitable to electrically connect the board cable to the respective electronic board; the remaining cable seats for the board cables are pass-through and the respective electrical cables are not engaged by insulation-piercing electrical contacts.

In one embodiment, the cables of the cable bundle are arranged alongside each other so as to form a flat bundle, also called a "strip". Correspondingly, the multipolar connectors have a predominantly linear extension, with the cable seats alongside each other and lying in a seat plane. In this way, the bundles of cables maintain the shape of a strip.

In one embodiment that allows facilitating the cabling of the bundle of cables to the multipolar connectors in an automatic or semi-automatic manner, all the multipolar connectors have the cable seat for the common cable positioned at a same end of the connector.

Furthermore, in one embodiment the cable seat of the board cable of the board connected to the insulation-piercing connector is positioned at the opposite end of the connector with respect to the cable seat for the common cable.

Therefore, as is evident from the cabling diagram of FIG. 2, the number of cables exiting from the multipolar connectors decreases proceeding from the opposite end with respect to the common cable.

Preferably, therefore, one can use connectors with a decreasing number of cable seats, arranging them from the largest header (facing the input connector) to the smallest (the terminal connector).

Figure 4:
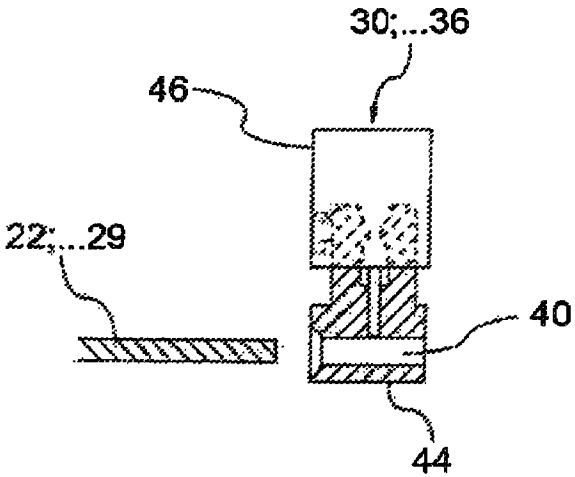
FIG. 4 shows, in axial section and in correspondence to a pass-through seat of a cable, an insulation-piercing multipolar connector in a retracted inactive position.
Figure 6:
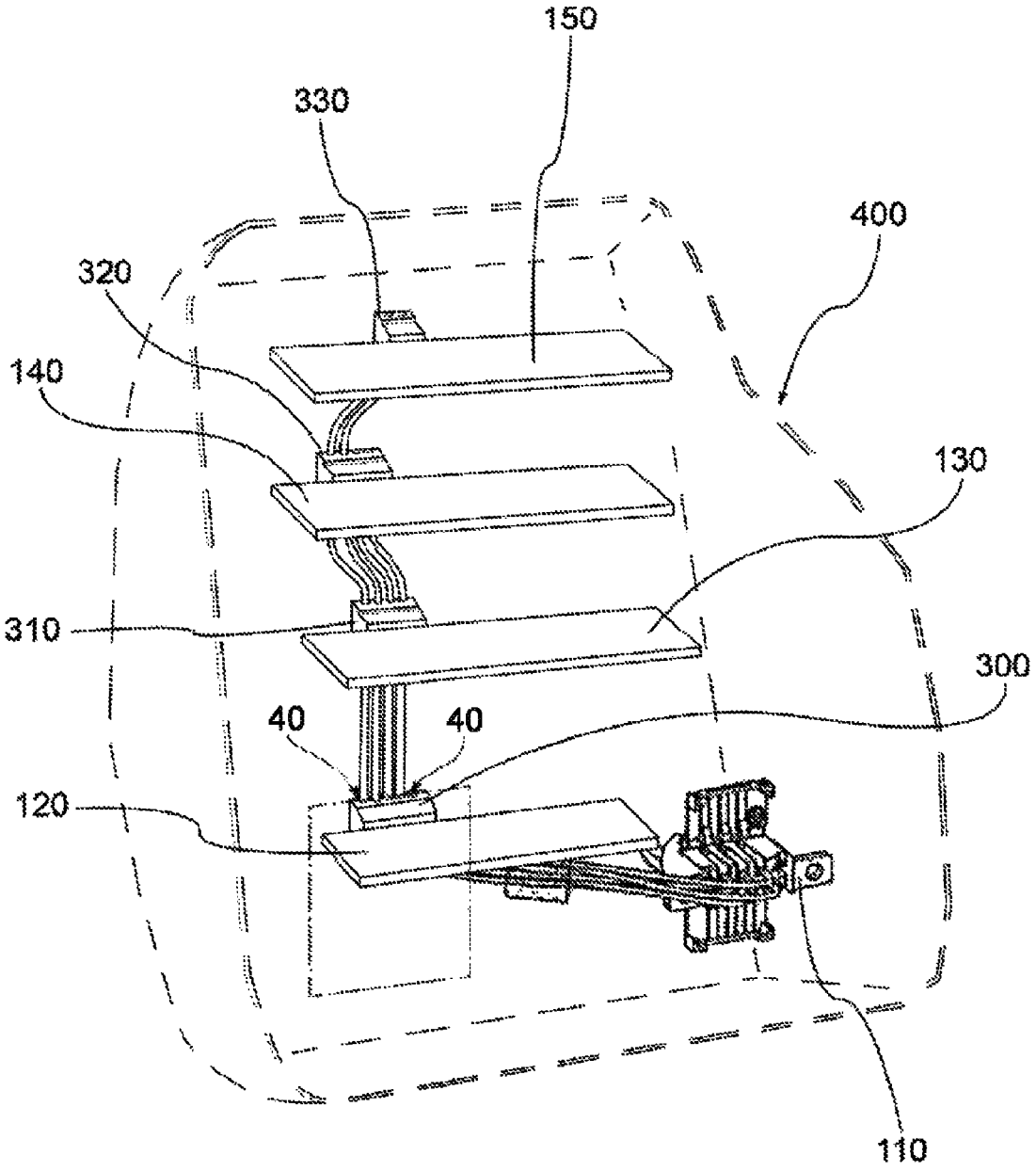
FIG. 6 shows a motor vehicle lamp comprising a plurality of electronic printed circuit boards connected with a cabling system according to the invention.

In one embodiment, the insulation-piercing multipolar connectors are Lumberg series 35, 2.5 pitch, "pass-through" connectors. An example of such connectors is shown in FIGS. 4-4*b*. In FIG. 4, note the pass-through cable seat 40 with the insulation-piercing electrical contact in the inactive retracted position; in FIG. 4*a*, note the electrical contact in the advanced position of piercing the insulating sheath of an electrical cable 22, . . . , 29; FIG. 4*b* shows a pass-through cable seat without insulation-piercing contact, with the sole function of guiding the cable that passes through the connector.

Figure 3:
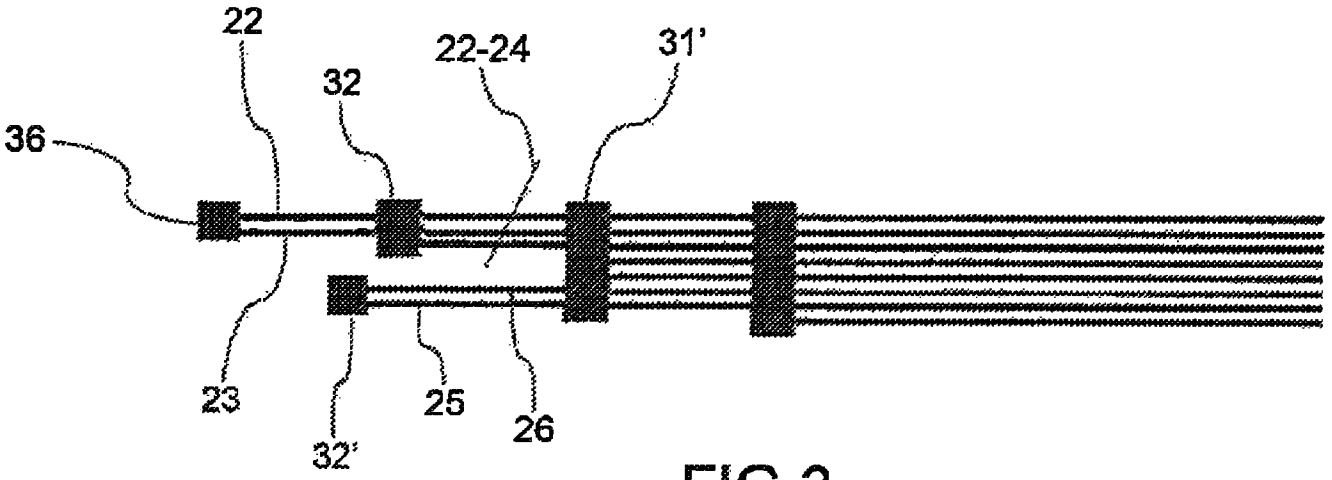
FIG. 3 is a schematic view of the cabling system according to the invention, in an embodiment variant.

In one embodiment, the cabling system can include intermediate bifurcations, as shown for example in FIG. 3. Here, from an intermediate connector 31', three cables 22, 23, 24 depart directed towards a first connector 32 and two other cables 25, 26 depart towards a second successive connector 32'. From the first successive connector 32, two electrical cables 22, 23 depart and terminate in the terminal connector 36.

FIG. 5 shows the cabling system according to the invention for the electronic boards of a motor vehicle lamp. The cabling system comprises an input connector 110, an electronic board for the brake light (Stop) 120, a first electronic board for a first group of light sources of a rear light (Tail Lower) 130, an electronic board for the turn signal (Turn) 140, and a second electronic board to a second group of rear light sources (Tail Up) 150. To each of these boards is fixed a respective insulation-piercing connector 300 to 310.

From the input electrical connector 110 extend a ground cable 220 that must be connected to all the electronic boards, a power supply cable for the rear light 230, which must be connected to both the first and the second board of the rear light, a power supply cable 240 of the electronic board 140 of the turn signal, a power supply cable 250 of the electronic board of the brake light 120, and a diagnostic cable 260 to be connected to the electronic board of the turn signal 140 to check the correct functioning of the turn signal.

As it can be seen from FIGS. 2 and 5, in all the connectors the seat for the ground cable is positioned at the left end of these connectors, and these are aligned along a reference line X tangent to that left end of all the connectors.

The five electrical cables 220-260 exiting from the input connector 110 enter the first insulation-piercing connector 300, which is therefore equipped with five ways or cable seats.

The power supply cable 250 of the electronic board of the brake light 120 ends in the first connector 300. Therefore, from this first connector extend four electrical cables 220, 240, 250, 260 that enter the second connector 310 of the first board for the rear light 130. Since, in this case, also the second board 150 for the rear light must be powered with the same power supply cable of the first board 230, from the second connector 310 exit four electrical cables 220, 230, 240, 260. Of course, of the four power cables that pass through the second connector 310, only the ground cable 220 and the power supply cable of the boards of the rear light 230 are cut by respective insulation-piercing electrical contacts. The other two cables are simply retained and guided by the second connector.

The four electrical cables enter the third connector 320 of the electronic board of the turn signal. In this third connector, the power supply cable of the respective board 240 and the diagnostic cable 260 end after being cut by the respective insulation-piercing electrical contacts.

Then, from the third connector, there exit only the first cables (from the left) 220, 230 of the initial bundle of cables: the ground cable 230 and the power supply cable 230 of the second board of the rear light. These two cables end in the fourth (terminal) connector 330.

Comparing the cabling system of FIG. 1 and FIG. 5, note how the second has no branch connectors, is much more orderly and has significantly shorter cables.

The cabling system according to the invention can be advantageously realised with an automatic or semi-automatic machine that implements the following method of cabling electronic printed circuit boards.

The cabling method according to the invention comprises the following steps:

preparing a bundle of electrical cables comprising the common electrical cable and a plurality of board cables;

preparing a plurality of multipolar insulation-piercing connectors, each being suitable to be connected to a respective electronic board for electrically connecting to said electronic board the common cable and at least one board cable, each connector being provided with a plurality of cable seats, at least some of said cable seats being engageable by an insulation-piercing electrical contact;

inserting, in a respective cable seat of each insulation-piercing connector, the common electrical cable, the board cable to be connected to the respective electronic board, and the board cables that must be connected to the successive connectors;

extracting from the respective cable seats of each insulation-piercing cable connector, with the exception of a terminal connector that terminates the bundle, the common electrical cable and the cables that must be connected to the successive connectors;

making the electrical contact between the electric cables and the respective boards.

Preferably, the connectors used have cable seats that are adjacent to one another and lie in a seat plane so as to form flat bundles of cables between the connectors.

Preferably, the cable seat for the common cable is positioned at one end of each insulation-piercing connector, and the connectors are positioned so as to be aligned with respect to a reference line tangent to said connector end.

This invention also covers a motor vehicle lamp 400 comprising a plurality of electronic printed circuit boards 120-150 suitable to drive respective light sources to realise lights of the lamp, an input electrical connector 110 provided at the entrance of the lamp and from which extends a bundle of cables comprising a grounding cable 220 to be connected to all the electronic boards and a plurality of power supply and/or other electrical signal cables, at least some of which to be independently connected to respective electronic boards, and a cabling system 10 of the bundle of cables to the electronic boards as described above.

To the embodiments of the cabling system and method according to the invention, a man skilled in the art, to satisfy contingent requirements, may make modifications, adaptations and replacements of members with others functionally equivalent, without departing from the scope of the following claims. Each of the characteristics described as belonging to a possible form of embodiment can be achieved independently from the other embodiments described.

What is claimed is:

1. A cabling system for connecting, to a plurality of electronic printed circuit boards, a common electrical cable, or respective electrical board cables, comprising:

a bundle of electrical cables comprising the common electrical cable and a plurality of electrical board cables, at least some of said electrical board cables being intended to be connected independently to respective electronic boards;

a plurality of multipolar, insulation-piercing connectors placed in succession along said bundle of electrical cables, each of said insulation-piercing connectors being suitable to be connected to a respective electronic board for electrically connecting, to said electronic board, the common electrical cable and at least one of said electrical board cables, each insulation-piercing connector, with the exception of a terminal connector that terminates the bundle of electrical cables, being suitable to receive the common electrical cable, the board cable to be connected to the respective electronic board, and the board cables that must be connected to the successive insulation-piercing connectors, and being suitable to transmit the common electrical cable and the electrical board cables that must be connected to the successive connectors.

2. The cabling system as set forth in claim 1, wherein each insulation-piercing connector is provided with cable seats electrically insulated from each other and suitable to receive respective cables of the bundle of electrical cables in input to the insulation-piercing connector, wherein the cable seats for the cables of the bundle of electrical cables that exit from the insulation-piercing connector are pass-through seats, and wherein the cable seats for the cables of the bundle of electrical cables that must be electrically connected to the electronic board to which the insulation-piercing connector is fixed, are engageable by respective insulation-piercing electrical contacts suitable to cut or pierce the respective electrical cable of the bundle of electrical cables.

3. The cabling system as set forth in claim 2, wherein the insulation-piercing connectors comprise at least one terminal connector, placed at the distal end of the bundle of electrical cables, and a header connector provided with cable seats electrically insulated from each other and suitable to receive all of the cables of the bundle of electrical cables, the cable seat for the common cable being pass-through and being engageable by an insulation-piercing electrical contact, a cable seat for an electrical board cable of the bundle of electrical cables being engageable by an insulation-piercing electrical contact suitable to electrically connect said electrical board cable to the electronic board connected to the header connector, the remaining cable seats for the board cables of the bundle of electrical cables being pass-through and having a function of retaining and guiding said electrical board cables.

4. The cabling system as set forth in claim 3, wherein the insulation-piercing connectors comprise at least one intermediate connector positioned between the terminal connector and the header connector, said at least one intermediate connector being provided with of a number of electrically insulated cable seats in which the common electrical cable and the electrical board cables coming from the header connector head or from a previous intermediate connector are inserted, the cable seat for the common electrical cable being pass-through and being engageable by an insulation-piercing electrical contact, a cable seat for an electrical board cable being engageable by an insulation-piercing electrical contact, the remaining cable seats for electrical board cables being pass-through seats with the function of retaining and guiding the respective electrical board cables.

5. The cabling system as set forth in claim 3, comprising an input connector from which there extends the bundle of electrical cables directed towards the header connector.

6. The cabling system as set forth in claim 2, wherein the cable seats are adjacent to one another and lie in a seat plane so as to form flat bundles of electrical cables between the insulation-piercing connectors.

7. The cabling system as set forth in claim 6, wherein the cable seat for the common electrical cable is positioned at one end of each insulation-piercing connector, and wherein the cable seat for the electrical board cable to be connected to the board connected to the insulation-piercing connector is positioned at the opposite end of said insulation-piercing connector.

8. A motor vehicle lamp, comprising a plurality of electronic printed circuit boards suitable to drive respective light sources to make lights of the lamp, an input electrical connector at the input of the lamp, from which extends a bundle of electrical cables comprising a common electrical cable to be connected to all the electronic boards and a plurality of electrical board cables, at least some of which to be independently connected to respective electronic boards, and a cabling system of the bundle of electrical cables to the electronic boards as set forth in claim 1.

9. A cabling method for connecting, to a plurality of electronic printed circuit boards, a common electrical cable, and respective electrical board cables, comprising the steps of:

preparing a bundle of electrical cables comprising the common electrical cable and a plurality of electrical board cables;

preparing a plurality of multipolar insulation-piercing connectors, each being suitable to be connected to a respective electronic board for electrically connecting to said electronic board the common electrical cable and at least one electrical board cable, each insulation-piercing connector being provided with a plurality of cable seats, at least some of said cable seats being engageable by an insulation-piercing electrical contact;

inserting, in a respective cable seat of each insulation-piercing connector, the common electrical cable, the electrical board cable to be connected to the respective electronic board, and the electrical board cables that must be connected to the successive insulation-piercing connectors;

extracting from the respective cable seats of each insulation-piercing cable connector, with the exception of a terminal connector that terminates the bundle of electrical cables, the common electrical cable and the electrical board cables that must be connected to the successive insulation-piercing connectors;

making the electrical contact between the electrical cables of the bundle of electrical cables and the respective boards.

10. The cabling method as set forth in claim 9, wherein the cable seats are adjacent to one another and lie in a seat plane so as to form flat bundles of electrical cables between the insulation-piercing connectors.

11. The cabling method as set forth in claim 10, wherein the cable seat for the common electrical cable is positioned at one end of each insulation-piercing connector, and wherein the insulation-piercing connectors are positioned so as to be aligned with respect to a reference line tangent to said insulation-piercing connector end.

* * * * *